United States Patent [19]

Byrne

[11] Patent Number: 4,834,327

[45] Date of Patent: May 30, 1989

[54] SELF-ADJUSTING CLIMBING CHOCK

[76] Inventor: Steve J. Byrne, 555 Blackbird Roost, #9, Flagstaff, Ariz. 86001

[21] Appl. No.: 137,737

[22] Filed: Dec. 24, 1987

[51] Int. Cl.[4] ..... A63B 29/02

[52] U.S. Cl. ..... 248/231.9; 248/200; 248/1 R

[58] Field of Search ..... 248/1, 200, 231.9, 317; 182/5; 294/94, 96

[56] References Cited

U.S. PATENT DOCUMENTS

| | | | |
|---|---|---|---|
| 4,506,924 | 3/1985 | Nieder | 294/96 X |
| 4,572,464 | 2/1986 | Phillips | 248/1 |
| 4,643,378 | 2/1987 | Guthrie et al. | 248/317 X |
| 4,715,568 | 12/1987 | Best, Jr. | 248/200 X |

FOREIGN PATENT DOCUMENTS

| | | | |
|---|---|---|---|
| 47232 | 3/1982 | European Pat. Off. | 248/1 |
| 2157355 | 10/1985 | United Kingdom | 248/1 |

*Primary Examiner*—J. Franklin Foss
*Assistant Examiner*—David L. Talbott
*Attorney, Agent, or Firm*—James H. Phillips; Charles E. Cates; Richard G. Harrer

[57] ABSTRACT

A self-adjusting climbing chock is disclosed which includes a main cable structure having a looped end and first and second cable end sections. A fixed wedge element is joined to the cable end sections, and one of the fixed wedge element faces is provided with a tapered depression. A translating wedge element, having a bearing surface which is complementary to the sliding surface of the depression, may be manually retracted against a compression spring between a first position at which the combined thickness of the fixed and translating wedge elements exceeds the maximum thickness of the fixed wedge element and a second position in which the combined thickness does not exceed the maximum thickness of the fixed wedge element. Thus, the adjustable climbing chock may be inserted into a crevice simultaneously with finger actuation of a transverse pull component to configure the wedge end of the chock into the insertion position such that subsequent release of the transverse pull component results in the spring returning the translating wedge element to a position between the first and second positions which is variable according to the thickness of the crevice at that point. In order to obtain a chock which is capable of accommodating to irregular inner crevice surfaces, the translating wedge element is preferably a spherical section cooperating with an inside cylindrical section depression. Embodiments employing a plurality of translating wedge elements are also disclosed.

11 Claims, 2 Drawing Sheets

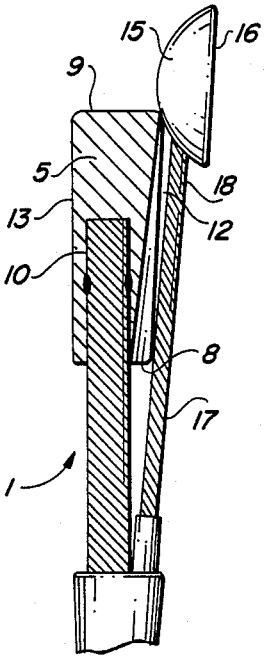
FIG. 3A
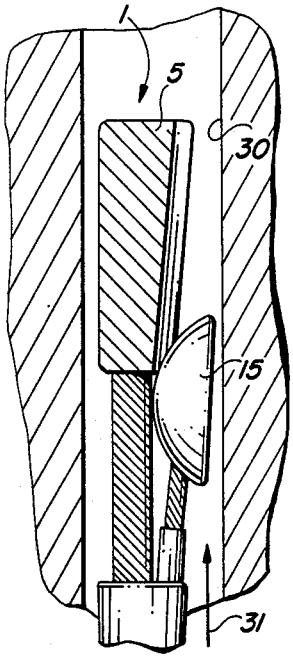
FIG. 3B
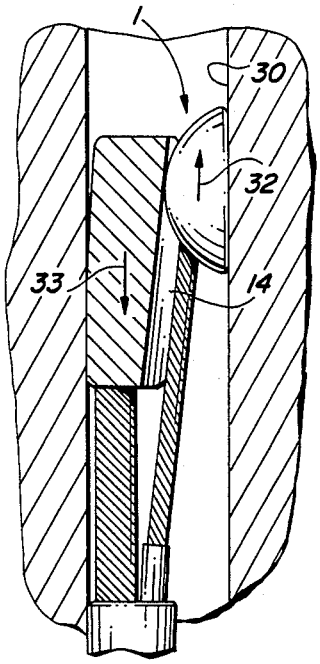
FIG. 3C
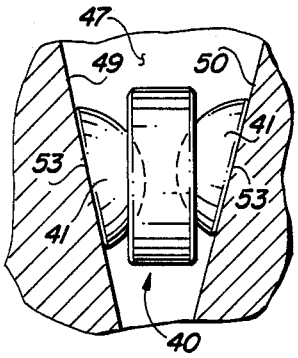
FIG. 6A
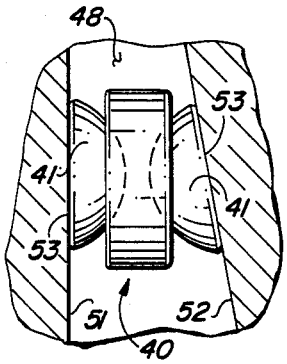
FIG. 6B
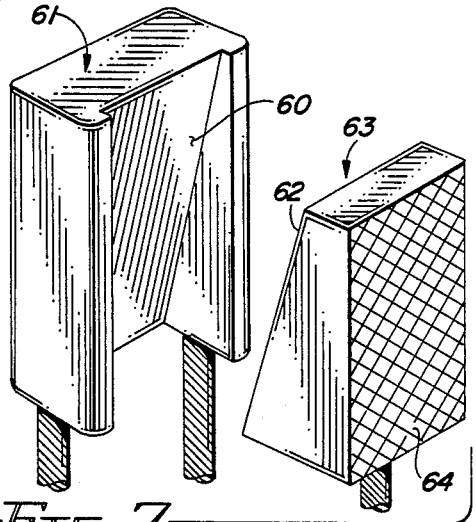
FIG. 7
FIG. 8A
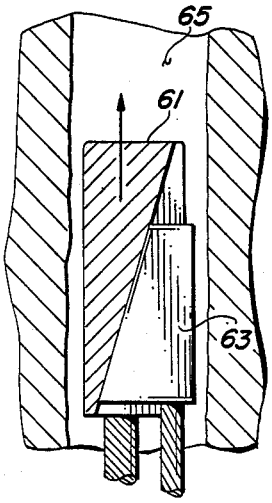
FIG. 8B
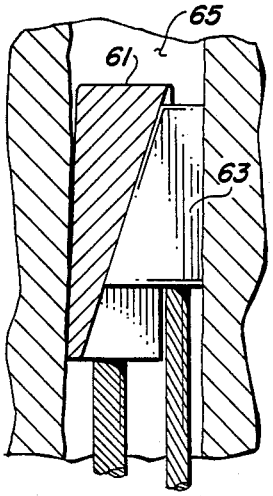
FIG. 9
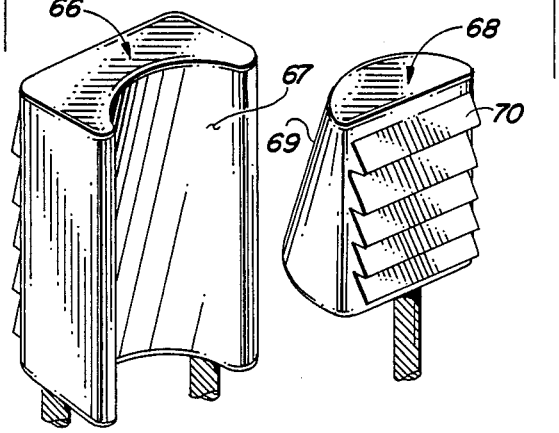

SELF-ADJUSTING CLIMBING CHOCK

FIELD OF THE INVENTION

This invention relates to the art of mountain and rock climbing equipment and, more particularly, to a self-adjusting climbing chock for temporary insertion into a crevice to provide a secure anchor point.

BACKGROUND OF THE INVENTION

In the difficult and dangerous sports of rock and mountain climbing, it is often necessary to emplace various implements in the climbing surface from time to time to provide secure anchor points which may be used, for example, to receive a rope and provide vertical support thereto as the climbing surface is incrementally scaled and also to effect a safety stop in the event of a fall or slip.

A certain class of such implements are generally termed "chocks". A chock is provided with a loop at one end and a crevice-engaging structure at the other end in order that it can be slipped into a crevice and wedged in place to effect the anchor point. In their simplest forms, chocks may be have no moving parts, and the crevice-engaging end may simply be a wedge shaped piece to which a loop structure is attached. Recently, however, more sophisticated chocks have come into use which employ complementary sliding wedges with a moving wedge element which may be drawn against a spring bias toward the climber for insertion into the crevice and then released to, in effect, increase the thickness of the effective wedge. Similar, more complex, chocks employ a cam action to obtain corresponding operation. Typical of the prior art chocks are those disclosed in U.S. Pat. Nos. 3,903,785 to Pepper, Jr.; 3,957,237 to Campbell; 4,082,241 to Burkey; 4,572,464 to Phillips; and 4,643,738 to Guthrie et al.

While these prior art climbing devices are meritorious, there nonetheless remains, in each example, a significant need for improvement in one or more of: the ability to conform to irregular crevice interior surfaces, structural strength, ease of one-handed operation, lightness, compactness, simplicity of structure, simplicity of manufacture and cost. It is to providing a climbing chock enjoying all these advantages that my invention is directed.

OBJECTS OF THE INVENTION

It is therefore a broad object of my invention to provide an improved climbing chock.

It is another object of my invention to provide such a climbing chock which can readily accommodate the irregular internal facing surfaces of a crevice.

It is a further object of my invention to provide such a climbing chock which is very strong structurally.

It is yet a further object of my invention to provide such a climbing chock which is simple and economical to manufacture.

It is a still yet further object of my invention to provide such a climbing chock which is lightweight and which may be readily and confidently operated by one hand.

SUMMARY OF THE INVENTION

These and other objects of my invention are achieved by a self adjusting climbing chock including a main cable structure having a looped end and first and second cable end sections. A fixed wedge element is joined to the cable end sections toward the edges of the wedge. In at least one of the fixed wedge element faces, a depression is provided which tapers from the inner end and outwardly diverges toward the outer end. A translating wedge element, having a bearing surface which is complementary to the sliding surface of the depression, may be manually retracted against a compression spring between a first position at which the combined thickness of the fixed and translating wedge elements exceeds the maximum thickness of the fixed wedge element and a second position in which the combined thickness does not exceed the maximum thickness of the fixed wedge element. Thus, the adjustable climbing chock may be inserted into a crevice simultaneously with finger actuation of a transverse pull component to configure the wedge end of the chock into the insertion position such that subsequent release of the transverse pull component results in the spring returning the translating wedge element to position between the first and second positions which is variable according to the thickness of the crevice at that point. Any tension placed on the looped end then simply more firmly anchors the chock.

In order to obtain a particularly effective adjustable chock which is capable of accommodating to irregular inner crevice surfaces, one preferred embodiment of the invention employs spherical section translating wedge element cooperating with a depression configured as an inside cylindrical section. As a result, a "universal-joint" action is obtained as the wedge end components of the climbing chock automatically adjust to the irregular surface within a crevice which it is engaging. Embodiments employing a plurality of translating wedge elements in conjunction with a corresponding plurality of depressions on different faces of a single fixed wedge element are also contemplated.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIGS. 3A, 3B and 3C illustrate the operation of the climbing chock as it is inserted into and anchored within an idealized crevice;

FIGS. 6A and 6B are top views of the chock embodiment shown in FIG. 4 and particularly illustrate a "universal-joint" functional characteristic enjoyed by both the foregoing embodiments;

FIG. 7 is a partial view of a third embodiment of the invention;

FIGS. 8A and 8B illustrate the manner in which the embodiment of the chock shown in FIG. 7 is used to anchor the chock within a crevice; and FIG. 9 is a partial view illustrating yet another embodiment of the chock.

DETAILED DESCRIPTION OF THE INVENTION

Figure 1:
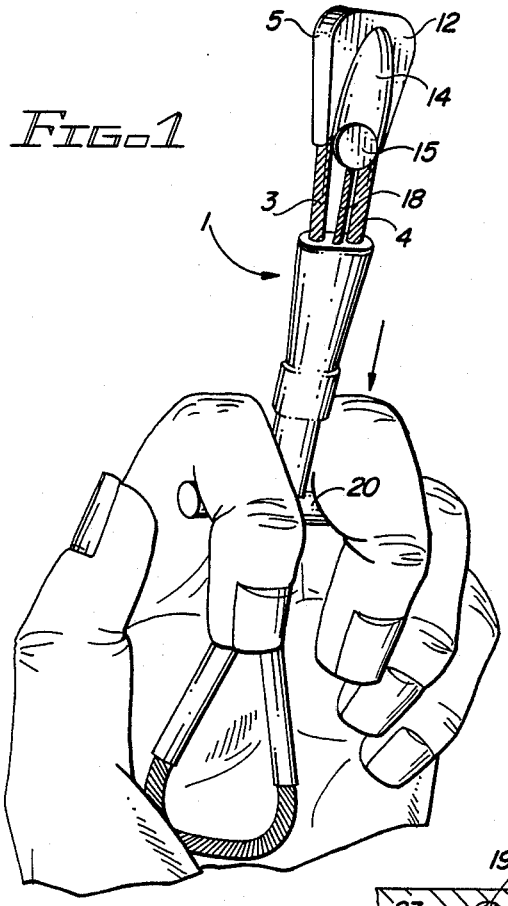
FIG. 1 is a pictorial view of one preferred embodiment of the present inventive climbing chock illustrating the manner of its manipulation.

Referring now to FIG. 1, there is shown a pictorial illustration of the embodiment of the invention which is presently particularly preferred because of its simplicity, strength and effectiveness. Those skilled in the art will appreciate that various chock sizes of otherwise substantially identical proportions may be provided and carried by a climber for his selection during a climb. The basic structure of the climbing chock may best be understood by simultaneous reference to FIGS. 1, 2A and 3A. The climbing chock 1 is configured around a main cable structure having a looped region 2 at its lower end and first and second cable end sections 3, 4 which are adjoined, respectively, to a fixed wedge element 5. Preferably, the cable end sections 3, 4 join the fixed wedge element 5 near the outboard edges 6, 7 of its inner end 8. As shown in the broken away region 10 of FIG. 3A, one method for securely adjoining the cable end sections 3, 4 to the fixed wedge element 5 is by providing blind holes in the inner end 8 to receive short lengths of the cable end sections such that the end sections may be bonded into place as by brazing or other appropriate means of sufficient strength given the application of the chock. The holes to which the cable end sections 3, 4 pass for adjoining to the fixed wedge element 5 are preferably placed, respectively, near the side edges 6, 7 to obtain balance and give strength to the entire structure.

The fixed wedge element 5 has upper and lower faces 12, 13, and in the embodiment of the chock under present discussion, a single depression 14 is provided in the upper face 12. The depression 14 tapers from the inner end 8 of the fixed wedge element toward the outer end 9 and is oriented such that the least thickness between the upper and lower faces 12, 13 is at the inner end 8 of the wedge element 5 and grows progressively greater toward the outer end 9.

A translating wedge element 15 is adapted to reside with a bearing surface within the depression 14, and a manually actuable system is provided for pulling the translating wedge element 15 between a first position (as shown in FIG. 3A) at which the combined thickness of the fixed wedge element 5 and the translating wedge element 15 exceeds the maximum thickness of the fixed wedge element 5 and a second position (see FIGS. 1 and 3B) at which the combined thickness of the fixed wedge element 5 and the translating wedge element 15 does not exceed the maximum thickness of the fixed wedge element 5. That is, the translating wedge element 15 has a bearing surface complementary to the contour of the engaged region of the depression 14 when the bearing surface is in contact with the depression. Thus, the taper of the depression 14 in coordination with the fore and aft movement of the translating wedge 15 governs the effective combined thickness of the structure.

Figure 2A:
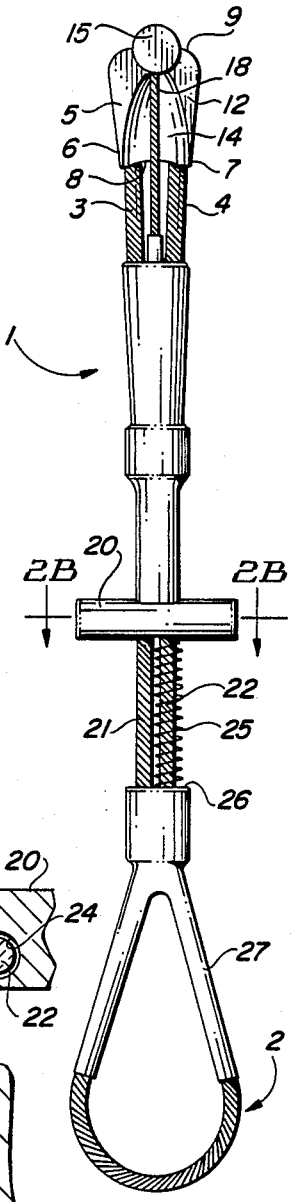
FIG. 2A is a front view of the climbing chock shown in FIG. 1.
Figure 2B:
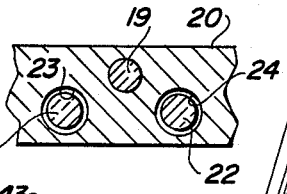
FIG. 2B is a partially cutaway cross sectional view taken along the lines 2B—2B of 2A.
Figure 4:
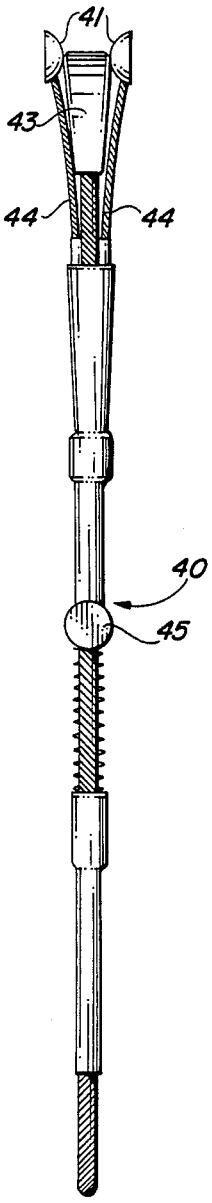
FIG. 4 is a side view of a second embodiment of the subject climbing chock.

As best shown in FIGS. 1 and 2A, the manually actuable retraction system includes a retracting cable 17 having a first end 18 connected to the translating wedge element 15 and a second end 19 fixed to a transverse movable, finger-actuable transverse pull component 2 situated intermediate the fixed wedge element 5 and the looped end 2 of the main cable structure. Referring also to FIG. 2B, first and second intermediate cable sections 21, 22 of the main cable structure are disposed, respectively, between the first cable end section 3 and the second cable end section 4. The intermediate cable sections are juxtaposed side by side and pass through respective apertures 23, 24 through the transverse pull component 20 to effect a guide structure for the transverse pull component. A compression spring 25 serves as a biasing element normally urging the translating wedge element 15 along the depression 14 away from the looped region 2; i.e., to the position shown in FIGS. 2A and 3A. The intermediate cable section 22 passes axially through the compression spring which bears at one end against the outer surface of the transverse pull component 20 and, at the other end, against a shoulder 26 of a sheath 27 which serves to maintain the definition of the looped region 2 of the main cable structure. Thus, the shoulder 26 serves as a lower stop for the compression spring 25.

Consider now the operation of the climbing chock 1 as sequentially illustrated in FIGS. 3A, 3B and 3C. In FIG. 3A, the chock 1 is shown in its relaxed position in which the translating wedge element 15 is in its outboard-most position. The climber pulls the translating wedge element 15 into its innermost position by actuating the transverse pull component 20 against the compression spring 25 simultaneously inserting the chock 1 into a crevice 30 as indicated by the arrow 31 in FIG. 3B. When the end of the chock 1 carrying the fixed wedge element 5 is in about the correct position within the crevice 30, the pull piece 20 is released, and the assembly is allowed to assume the position illustrated in FIG. 3C under the influence of the compression spring 25. Thus, the translating wedge element 15 tends to move upwardly in the depression 14 in the direction indicated by the arrow 32 while the fixed wedge element 5 tends to move downwardly as indicated by the arrow 33, this cooperative action securely wedging the entire structure in the crevice 30 such that any tensile force applied to withdraw the assembly from the crevice 30 will simply further tighten it into place. Withdrawal of the chock 1 from the crevice 30 may be readily effected by simply pulling the transverse pull component 20 against the compression spring again to release the assembly such that it may be withdrawn in the direction opposite to that indicated by the arrow 31 in FIG. 3B.

It is contemplated that a plurality of translating wedge elements may be employed in conjunction with a plurality of depressions provided on a corresponding plurality of faces of a single fixed wedge element to obtain variant configurations of the chock. Thus, referring now to FIGS. 4, 5A, 5B and 5C, a climbing chock 40 is shown which includes a pair of translating wedge elements 41 movable within depressions 42 situated on opposite faces of a fixed wedge element 43. The fore and aft movement of the translating wedge elements 41 is carried out in synchronism by employing a pair of retracting cables 44 which are both connected to transverse pull component 45 in the manner previously described.

Figure 5A:
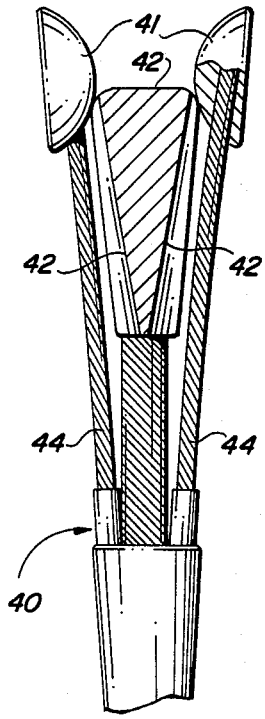
FIGS. 5A, 5B and 5C are views similar to FIGS. 3A, 3B and 3C, respectively, and illustrate the use of the chock embodiment shown in FIG. 4 in a somewhat wider idealized crevice.
Figure 5B:
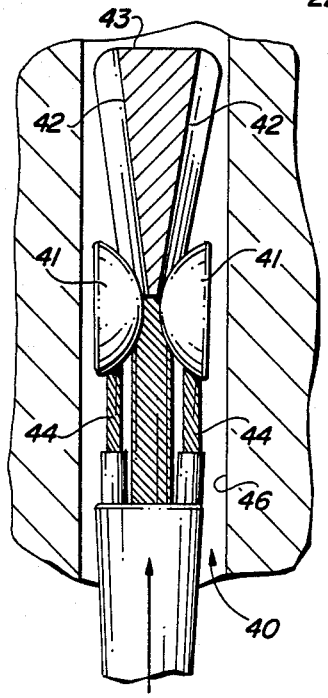
Figure 5C:
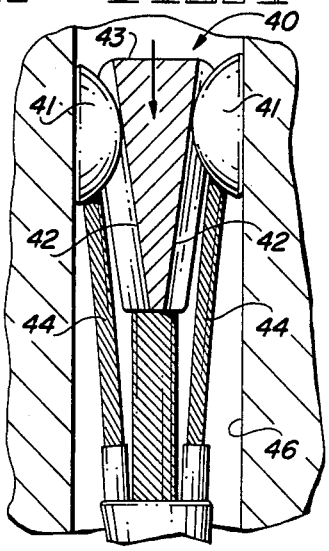

As shown in FIGS. 5A, 5B and 5C, the chock 40 is used in the same manner previously described for the chock 1 in conjunction with FIGS. 3A, 3B and 3C. That is, as shown in FIG. 5B, the chock 40 is inserted into the crevice 46 with the translating wedge elements 41 in a retracted position to permit entry, and then, as shown in FIG. 5C, the translating wedge elements 41 are emplaced by releasing the transverse pull piece 45 (FIG. 4) permitting the wedge assembly to adjust itself to the width of the crevice 46 and anchor the chock 40 until it is subsequently removed as previously described for the chock 1.

Referring again to FIG. 5A, the broken away region 39 illustrates that the translating wedge element may be coupled securely to the retracting cable 44 in much the manner previously described four adjoining the cable end sections 3, 4 to the fixed wedge element 5.

Of particular importance to the climbing chock 1 and the variant chock 40 so far described is the interrelationship of the respective shapes of the translating wedge elements 15, 41 and the depressions 14, 42. Preferably, the translating wedge element is a spherical section (such as a hemisphere) having an outer face and oriented with a spherical portion of its surface nesting in the depression in which it resides during fore and aft movement in the depression. This configuration achieves a very effective self adjusting action somewhat in the nature of a "universal-joint". For maximum effectiveness, the depressions 14, 42 is an inside cylindrical section dimensioned such that the engaging bearing surfaces of the translating wedge elements and the depressions are complementary; i.e., the spherical section of a given translating wedge element has about the same radius as the cylindrical section surface of the depression in which it resides.

The "universal-joint" action which is obtained with this configuration is illustrated in FIGS. 6A and 6B which are top views of a dual translating wedge chock 40 inserted, respectively, into irregular crevices 47 and 48; i.e., crevices in which the opposing faces 49, 50 and 51, 52 respectively, are not parallel. Thus, the translating wedge elements 41 inherently pivot as may be necessary (and in three axes) for the outer faces 53 to engage the crevice walls to the maximum extent. It will be appreciated and understood that the single translating wedge element 15 of the embodiment of the invention illustrated in FIGS. 1, 2A, 2B, 3A, 3B and 3C will function in a fully "universal-joint" equivalent action with the lower face 13 of the fixed wedge element accommodating itself to one crevice wall and the outer face 16 of the translating wedge element 15 accommodating itself to the other crevice wall.

As shown in FIGS. 7, 8A, 8B and 9, other complementary engaging surfaces for the translating wedge element and the fixed wedge element may be employed. Thus, as shown in FIG. 7, a generally planar-floored depression 60 of the fixed wedge element 61 engages the complementary surface 62 of a translating wedge element 63. Optionally, the outer surface 64 of the translating wedge element 63 may be knurled or otherwise patterned to increase its gripping characteristics. A corresponding surface may be employed on the outboard surface (out of view in FIG. 7) of the fixed wedge element 61. In practice, it has been found that any improvement in gripping function obtained by such pattern treatment is incremental and is usually not necessary.

FIGS. 8A and 8B illustrate, respectively, the insertion and engagement of a chock employing the fixed wedge element 61 and the translating wedge element 63 in a crevice 65. It will be noted that the "universal-joint" action obtained by the use of spherical section translating wedge elements and cylindrical section depressions is not obtained in this embodiment of the invention although a very strong structure is realized.

An embodiment of the invention which, in a certain sense, is intermediate between the "universal-joint" embodiments of the invention previously described and the substantially fixed position embodiment illustrated in FIGS. 7, 8A and 8B is shown in FIG. 9. Thus, the fixed wedge element 66 has a generally cylindrical section depression 67 for receiving the correspondingly generally cylindrical outer bearing surface 69 of translating wedge element 68. With this configuration, the translating wedge element 68 may undergo circumferential adjustment to accommodate corresponding irregularities in facing crevice walls by pivoting about the axis of the cylinder of which the surface 69 is a section. The outer face 70 of the translating wedge element 68 illustrates yet another optional finish which, for certain conditions, may improve the gripping power of the chock.

While the principles of the invention have now been made clear in illustrative embodiments, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A self adjusting climbing chock comprising:

(A) a main cable structure having a looped region and first and second cable sections;

(B) a fixed wedge element having:
  1. upper and lower faces;
  2. first and second edges; and
  3. inner and outer ends;

(C) first and second coupling means securely adjoining, respectively:
  1. said first cable end section to said fixed wedge element inner end proximate said first edge thereof; and
  2. said second cable end section to said fixed wedge element inner end proximate said second edge thereof;

(D) a depression in at least one of said fixed wedge element faces, said depression:
  1. tapering from said inner end of said fixed wedge element toward said outer end thereof; and
  2. being oriented such that the least thickness between said upper and lower faces of said fixed wedge element is at said inner end thereof, said thickness becoming progressively greater from said inner end of said fixed wedge toward said outer end thereof;

(E) a translating wedge element adapted to reside with a bearing surface thereof within said depression and being a spherical section having an outer face and oriented with a spherical portion of its surface being the bearing surface residing within said depression;

(F) manually actuable retraction means for pulling said translating wedge element between:
  1. a first position at which the combined thickness of said fixed wedge element and said translating wedge element exceeds the maximum thickness of said fixed wedge element; and
  2. a second position at which the combined thickness of said fixed wedge element and said translating wedge element does not exceed the maximum thickness of said fixed wedge element; and (G) biasing means urging said translating wedge element along said depression away from said looped region of said cable structure.

2. The self adjusting climbing chock of claim 1 in which said depression is configured as an inside cylindrical section.

3. The self adjusting climbing chock of claim 2 which includes:

(A) a plurality of said depressions;

(B) a plurality of said translating wedge elements, each of said wedge elements residing in one of said depressions; and (C) coordinating means for moving said translating wedge elements between their respective first and second positions in synchronism.

4. The self adjusting climbing chock of claim 2 wherein said depression is dimensioned such that the bearing surface of the translating wedge element and the depression are complementary in that the spherical section of said translating wedge has about the same radius as the cylindrical section surface of said depression.

5. The self adjusting climbing chock of claim 1 or 2 in which:

(A) said manually actuable retraction means includes:

1. a retracting cable having first and second ends;
2. third coupling means securely adjoining said first end of said retracting cable to said translating wedge element;
3. a movable, finger-actuable transverse pull component situated intermediate said fixed wedge element and said looped end of said main cable structure; and
4. fourth coupling means securely adjoining said second end of said retracting cable to said transverse pull component; and (B) said biasing means includes a spring having first and second ends:

1. said first end of said spring being coupled to said main cable structure; and
2. said second end of said spring being coupled to said transverse pull component.

6. The self-adjusting climbing chock of claim 5 which includes:

(A) a plurality of said depressions;

(B) a plurality of said translating wedge elements, each of said wedge elements residing in one of said depressions; and (C) coordinating means for moving said translating wedge elements between their respective first and second positions in synchronism.

7. The self adjusting climbing chock of claim 5 which further includes:

(A) a spring stop fixed to said main cable structure and situated between said transverse pull component and said looped end of said main cable structure;

and in which:

(B) said spring is a compression spring;

(C) said first end of said compression spring bears against said stop; and (D) said second end of said compression spring bears against said transverse pull component.

8. The self adjusting climbing chock of claim 7 which includes:

(A) a plurality of said depressions;

(B) a plurality of said translating wedge elements, each of said wedge elements residing in one of said depressions; and (C) coordinating means for moving said translating wedge elements between their respective first and second positions in synchronism.

9. The self-adjusting climbing chock of claim 7 in which:

(A) said main cable structure includes:

1. a first intermediate section disposed between said first cable end section and said looped region; and
2. a second intermediate section disposed between said second cable end section and said looped region;

(B) said first intermediate section passes axially through said compression spring;

(C) said transverse pull component includes an aperture therethrough; and (D) said second intermediate section passes through said aperture to effect a guide for said transverse pull component.

10. The self-adjusting climbing chock of claim 9 which includes:

(A) a plurality of said depressions;

(B) a plurality of said translating wedge elements, each of said wedge elements residing in one of said depressions; and (C) coordinating means for moving said translating wedge elements between their respective first and second positions in synchronism.

11. The self-adjusting climbing chock of claim 1 which includes:

(A) a plurality of said depressions;

(B) a plurality of said translating wedge elements, each of said wedge elements residing in one of said depressions; and (C) coordinating means for moving said translating wedge elements between their respective first and second positions in synchronism.

* * * * *

UNITED STATES PATENT AND TRADEMARK OFFICE

CERTIFICATE OF CORRECTION

PATENT NO. : 4,834,327

DATED : May 30, 1989

INVENTOR(S) : Steve J. Byrne

It is certified that error appears in the above-identified patent and that said Letters Patent is hereby corrected as shown below:

In Claim 1, in line 32 of column 6, the word --end-- should be inserted after the word "cable"

In claim 1, in line 53 of column 6, the word --element-- should be inserted after the word "wedge"

Signed and Sealed this

Thirteenth Day of March, 1990

*Attest:*

JEFFREY M. SAMUELS

*Attesting Officer*

*Acting Commissioner of Patents and Trademarks*